US006912495B2

(12) United States Patent
Griffin et al.

(10) Patent No.: US 6,912,495 B2
(45) Date of Patent: Jun. 28, 2005

(54) SPEECH MODEL AND ANALYSIS, SYNTHESIS, AND QUANTIZATION METHODS

(75) Inventors: Daniel W. Griffin, Hollis, NH (US); John C. Hardwick, Sudbury, MA (US)

(73) Assignee: Digital Voice Systems, Inc., Westford, MA (US)

( * ) Notice: Subject to any disclaimer, the term of this patent is extended or adjusted under 35 U.S.C. 154(b) by 738 days.

(21) Appl. No.: 09/988,809

(22) Filed: Nov. 20, 2001

(65) Prior Publication Data

US 2003/0097260 A1 May 22, 2003

(51) Int. Cl.[7] ..... G10L 11/06; G10L 19/02; G10L 19/08; G10L 19/12

(52) U.S. Cl. ..... 704/208; 704/203; 704/214; 704/220; 704/223

(58) Field of Search ..... 704/208, 214, 704/219, 220, 223, 203

(56) References Cited

U.S. PATENT DOCUMENTS 5,113,449 A * 5/1992 Blanton et al. ..... 704/261
5,195,166 A * 3/1993 Hardwick et al. ..... 704/200
5,293,449 A * 3/1994 Tzeng ..... 704/223
5,633,980 A * 5/1997 Ozawa ..... 704/221
5,659,664 A * 8/1997 Kaja ..... 704/265
5,752,223 A * 5/1998 Aoyagi et al. ..... 704/219
5,754,974 A * 5/1998 Griffin et al. ..... 704/206
5,864,797 A * 1/1999 Fujimoto ..... 704/223
6,044,345 A * 3/2000 Veldhuis ..... 704/261
6,345,255 B1 * 2/2002 Mermelstein ..... 704/500
6,377,915 B1 * 4/2002 Sasaki ..... 704/206
6,424,941 B1 * 7/2002 Yu ..... 704/221
6,463,406 B1 * 10/2002 McCree ..... 704/207

OTHER PUBLICATIONS

Quatieri Jr. et al., Iterative techniques for minimum phase signal reconstruction from phase or magnitude, Dec. 1981, ASSP, vol.: 29, Issue: 6, pp.: 1187–1193.*

(Continued)

*Primary Examiner*—Tālivaldis Ivars Šmits
*Assistant Examiner*—Myriam Pierre
(74) *Attorney, Agent, or Firm*—Fish & Richardson P.C.

(57) ABSTRACT

An improved speech model and methods for estimating the model parameters, synthesizing speech from the parameters, and quantizing the parameters are disclosed. The improved speech model allows a time and frequency dependent mixture of quasi-periodic, noise-like, and pulse-like signals. For pulsed parameter estimation, an error criterion with reduced sensitivity to time shifts is used to reduce computation and improve performance. Pulsed parameter estimation performance is further improved using the estimated voiced strength parameter to reduce the weighting of frequency bands which are strongly voiced when estimating the pulsed parameters. The voiced, unvoiced, and pulsed strength parameters are quantized using a weighted vector quantization method using a novel error criterion for obtaining high quality quantization. The fundamental frequency and pulse position parameters are efficiently quantized based on the quantized strength parameters. These methods are useful for high quality speech coding and reproduction at various bit rates for applications such as satellite voice communication.

45 Claims, 3 Drawing Sheets

New Speech Model

OTHER PUBLICATIONS

Gottesmann, Dispersion phase vector quantization for enhancement of waveform interpolative coder,Mar. 1999, ICASSP '99 Proceedings, vol.: 1, 15–19, pp.: 269–272.*

Chan–Joong et al., On a low bit rate speech coder using multi–level amplitude algebraic method, Oct.–3–Nov. 1999, MILCOM 31, vol.: 2, pp.: 1444–1448.*

Plumpe, et al., Modeling of the glottal flow derivative waveform with application to speaker identification, Sep. 1999, Speech and Audio Processing, vol.: 7, Issue: 5, pp.: 569–586.*

European Search Report (Application No. 02258005.4), Jul. 12, 2004, 2 pages.

Han, W–J et al., "Mixed Multi–Band Excitation Coder Using Frequency Domain Mixture Function (FDMF) for a Low Bit–Rate Speech Coding,"EuroSpeech '97, Sep. 22–25, 1997, pp. 1311–1314.

Kwon S Y et al., "An Enhanced Lpc Vocoder With No Voiced/Uncoiced Switch," vol. ASSP–32, No. 4, Aug. 1984, pp. 851–858.

* cited by examiner

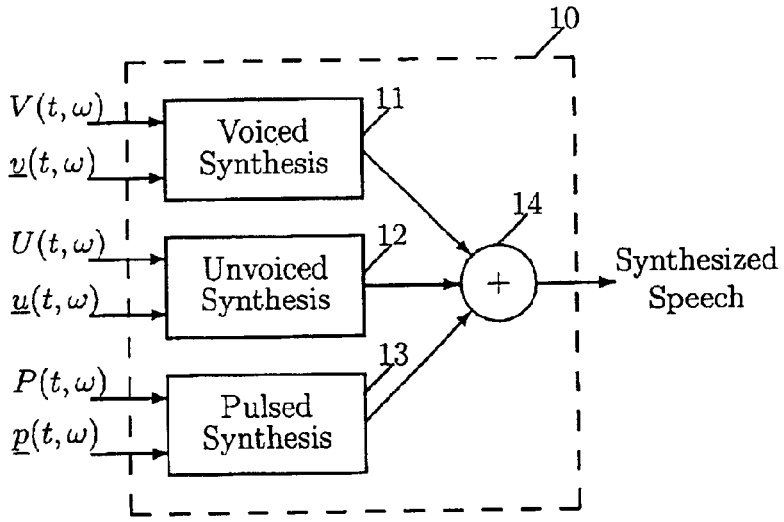
Figure 1: New Speech Model
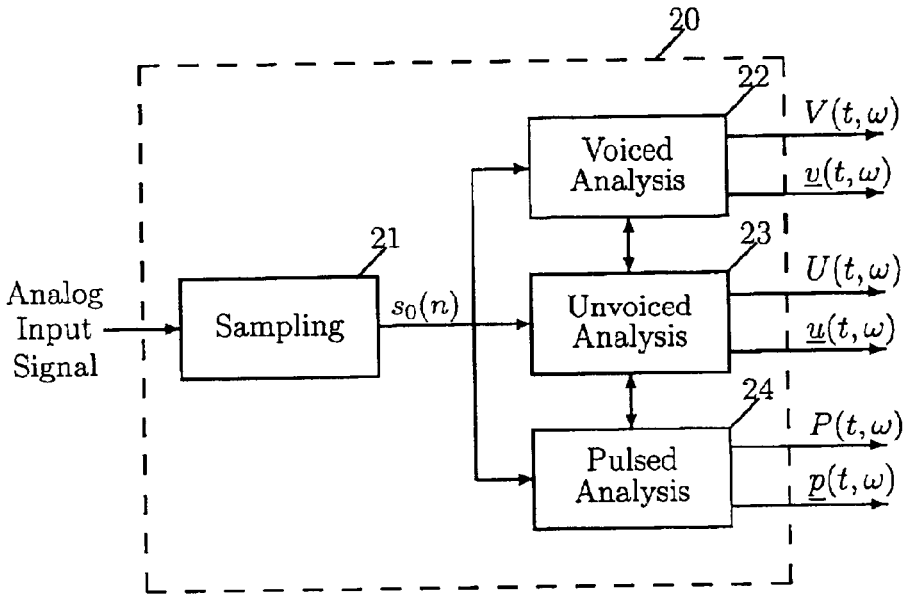
Figure 2: Speech Analysis

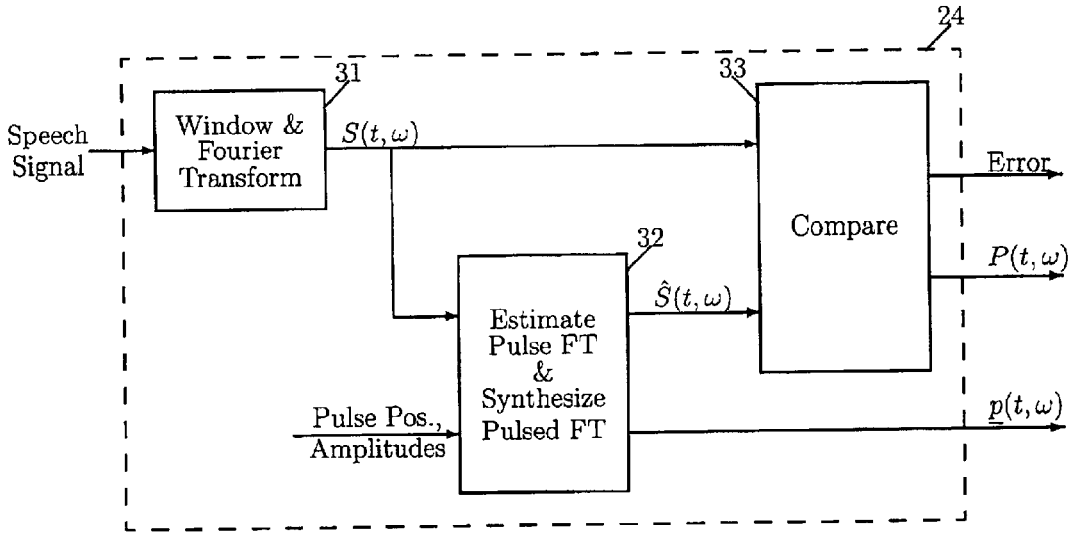
Figure 3: Pulsed Analysis
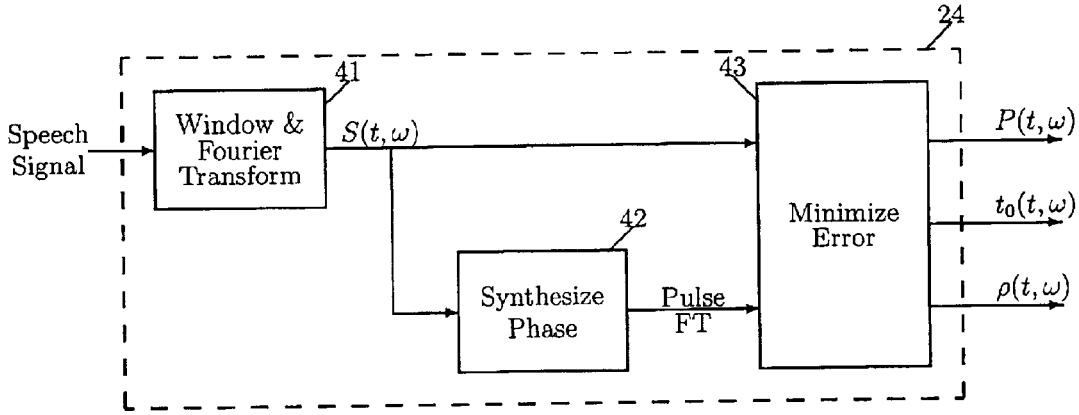
Figure 4: Reduced Complexity Pulsed Analysis

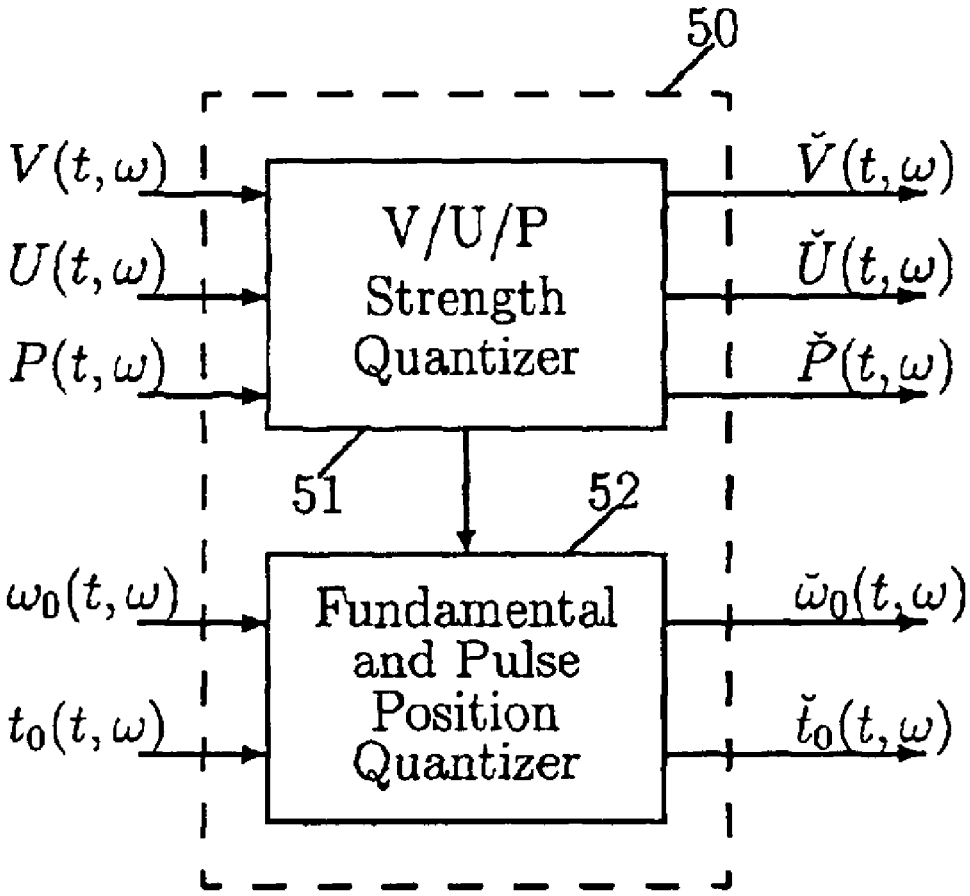
Figure 5: Excitation Parameter Quantizer

SPEECH MODEL AND ANALYSIS, SYNTHESIS, AND QUANTIZATION METHODS

BACKGROUND

The invention relates to an improved model of speech or acoustic signals and methods for estimating the improved model parameters and synthesizing signals from these parameters.

Speech models together with speech analysis and synthesis methods are widely used in applications such as telecommunications, speech recognition, speaker identification, and speech synthesis. Vocoders are a class of speech analysis/synthesis systems based on an underlying model of speech. Vocoders have been extensively used in practice. Examples of vocoders include linear prediction vocoders, homomorphic vocoders, channel vocoders, sinusoidal transform coders (STC), multiband excitation (MBE) vocoders, improved multiband excitation (IMBE™), and advanced multiband excitation vocoders (AMBE™).

Vocoders typically model speech over a short interval of time as the response of a system excited by some form of excitation. Typically, an input signal $s_0(n)$ is obtained by sampling an analog input signal. For applications such as speech coding or speech recognition, the sampling rate ranges typically between 6 kHz and 16 kHz. The method works well for any sampling rate with corresponding changes in the associated parameters. To focus on a short interval centered at time t, the input signal $s_0(n)$ is typically multiplied by a window w(t,n) centered at time t to obtain a windowed signal s(t,n). The window used is typically a Hamming window or Kaiser window and can be constant as a function of t so that $w(t,n)=w_0(n-t)$ or can have characteristics which change as a function of t. The length of the window w(t,n) typically ranges between 5 ms and 40 ms. The windowed signal s(t,n) is typically computed at center times of $t_0, t_1, \ldots t_m, t_{m+1}, \ldots$. Typically, the interval between consecutive center times $t_{m+1}-t_m$ approximates the effective length of the window w(t,n) used for these center times. The windowed signal s(t,n) for a particular center time is often referred to as a segment or frame of the input signal.

For each segment of the input signal, system parameters and excitation parameters are determined. The system parameters typically consist of the spectral envelope or the impulse response of the system. The excitation parameters typically consist of a fundamental frequency (or pitch period) and a voiced/unvoiced (V/UV) parameter which indicates whether the input signal has pitch (or indicates the degree to which the input signal has pitch). For vocoders such as MBE, IMBE, and AMBE, the input signal is divided into frequency bands and the excitation parameters may also include a V/UV decision for each frequency band. High quality speech reproduction may be provided using a high quality speech model, an accurate estimation of the speech model parameters, and high quality synthesis methods.

When the voiced/unvoiced information consists of a single voiced/unvoiced decision for the entire frequency band, the synthesized speech tends to have a "buzzy" quality especially noticeable in regions of speech which contain mixed voicing or in voiced regions of noisy speech. A number of mixed excitation models have been proposed as potential solutions to the problem of "buzziness" in vocoders. In these models, periodic and noise-like excitations which have either time-invariant or time-varying spectral shapes are mixed.

In excitation models having time-invariant spectral shapes, the excitation signal consists of the sum of a periodic source and a noise source with fixed spectral envelopes. The mixture ratio controls the relative amplitudes of the periodic and noise sources. Examples of such models are described by Itakura and Saito, "Analysis Synthesis Telephony Based upon the Maximum Likelihood Method," *Reports of 6th Int. Cong. Acoust.*, Tokyo, Japan, Paper C-5-5, pp. C17–20, 1968; and Kwon and Goldberg, "An Enhanced LPC Vocoder with No Voiced/Unvoiced Switch," *IEEE Trans. on Acoust., Speech, and Signal Processing*, vol. ASSP-32, no. 4, pp. 851–858, August 1984. In these excitation models, a white noise source is added to a white periodic source. The mixture ratio between these sources is estimated from the height of the peak of the autocorrelation of the LPC residual.

In excitation models having time-varying spectral shapes, the excitation signal consists of the sum of a periodic source and a noise source with time varying spectral envelope shapes. Examples of such models are decribed by Fujimara, "An Approximation to Voice Aperiodicity," *IEEE Trans. Audio and Electroacoust.*, pp. 68–72, March 1968; Makhoul et al, "A Mixed-Source Excitation Model for Speech Compression and Synthesis," *IEEE Int. Conf. on Acoust. Sp. & Sig. Proc.*, April 1978, pp. 163–166; Kwon and Goldberg, "An Enhanced LPC Vocoder with No Voiced/Unvoiced Switch," *IEEE Trans. on Acoust., Speech, and Signal Processing*, vol. ASSP-32, no. 4, pp. 851–858, August 1984; and Griffin and Lim, "Multiband Excitation Vocoder," *IEEE Trans. Acoust., Speech, Signal Processing*, vol. ASSP-36, pp. 1223–1235, August 1988.

In the excitation model proposed by Fujimara, the excitation spectrum is divided into three fixed frequency bands. A separate cepstral analysis is performed for each frequency band and a voiced/unvoiced decision for each frequency band is made based on the height of the cepstrum peak as a measure of periodicity.

In the excitation model proposed by Makhoul et al., the excitation signal consists of the sum of a low-pass periodic source and a high-pass noise source. The low-pass periodic source is generated by filtering a white pulse source with a variable cut-off low-pass filter. Similarly, the high-pass noise source was generated by filtering a white noise source with a variable cut-off high-pass filter. The cut-off frequencies for the two filters are equal and are estimated by choosing the highest frequency at which the spectrum is periodic. Periodicity of the spectrum is determined by examining the separation between consecutive peaks and determining whether the separations are the same, within some tolerance level.

In a second excitation model implemented by Kwon and Goldberg, a pulse source is passed through a variable gain low-pass filter and added to itself, and a white noise source is passed through a variable gain high-pass filter and added to itself. The excitation signal is the sum of the resultant pulse and noise sources with the relative amplitudes controlled by a voiced/unvoiced mixture ratio. The filter gains and voiced/unvoiced mixture ratio are estimated from the LPC residual signal with the constraint that the spectral envelope of the resultant excitation signal is flat.

In the multiband excitation model proposed by Griffin and Lim, a frequency dependent voiced/unvoiced mixture function is proposed. This model is restricted to a frequency dependent binary voiced/unvoiced decision for coding purposes. A further restriction of this model divides the spectrum into a finite number of frequency bands with a binary voiced/unvoiced decision for each band. The voiced/ unvoiced information is estimated by comparing the speech spectrum to the closest periodic spectrum. When the error is below a threshold, the band is marked voiced, otherwise, the band is marked unvoiced.

The Fourier transform of the windowed signal s(t,n) will be denoted by S(t,w) and will be referred to as the signal Short-Time Fourier Transform (STFT). Suppose $s_0(n)$ is a periodic signal with a fundamental frequency $w_0$ or pitch period $n_0$. The parameters $w_0$ and no are related to each other by $2\pi/w_0=n_0$. Non-integer values of the pitch period $n_0$ are often used in practice.

A speech signal $s_0(n)$ can be divided into multiple frequency bands using bandpass filters. Characteristics of these bandpass filters are allowed to change as a function of time and/or frequency. A speech signal can also be divided into multiple bands by applying frequency windows or weightings to the speech signal STFT S(t,w).

SUMMARY

In one aspect, generally, methods for synthesizing high quality speech use an improved speech model. The improved speech model is augmented beyond the time and frequency dependent voiced/unvoiced mixture function of the multiband excitation model to allow a mixture of three different signals. In addition to parameters which control the proportion of quasi-periodic and noise-like signals in each frequency band, a parameter is added to control the proportion of pulse-like signals in each frequency band. In addition to the typical fundamental frequency parameter of the voiced excitation, additional parameters are included which control one or more pulse amplitudes and positions for the pulsed excitation. This model allows additional features of speech and audio signals important for high quality reproduction to be efficiently modeled.

In another aspect, generally, analysis methods are provided for estimating the improved speech model parameters. For pulsed parameter estimation, an error criterion with reduced sensitivity to time shifts is used to reduce computation and improve performance. Pulsed parameter estimation performance is further improved using the estimated voiced strength parameter to reduce the weighting of frequency bands which are strongly voiced when estimating the pulsed parameters.

In another aspect, generally, methods for quantizing the improved speech model parameters are provided. The voiced, unvoiced, and pulsed strength parameters are quantized using a weighted vector quantization method using a novel error criterion for obtaining high quality quantization. The fundamental frequency and pulse position parameters are efficiently quantized based on the quantized strength parameters.

In one general aspect, a method of analyzing a digitized signal to determine model parameters for the digitized signal is provided. The method includes receiving a digitized signal, determining a voiced strength for the digitized signal by evaluating a first function, and determining a pulsed strength for the digitized signal by evaluating a second function. The voiced strength and the pulsed strength may be determined, for example, at regular intervals of time. In some implementations, the voiced strength and the pulsed strength may be determined on one or more frequency bands. In addition, the same function may be used as both the first function and the second function.

The voiced strength and the pulsed strength may be used to encode the digitized signal. In some implementations, the pulse signal may be determined using a pulse signal estimated from the digitized signal. The voiced strength may also be used in determining pulsed strength. Additionally, the pulsed signal may be determined by combining a transform magnitude with a transform phase computed from a transform magnitude. The transform phase may be near minimum phase. In some implementations, the pulsed strength may be determined using a pulsed signal estimated from a pulse signal and at least one pulse position.

The pulsed strength may be determined by comparing a pulsed signal with the digitized signal. The comparison may be made using an error criterion with reduced sensitivity to time shifts. The error criterion may compute phase differences between frequency samples and may remove the effect of constant phase differences. Additional implementations of the method of analyzing a digitized signal further include quantizing the pulsed strength using a weighted vector quantization, and quantizing the voiced strength using weighted vector quantization. The voiced strength and the pulsed strength may be used to estimate one or more model parameters. Implementations may also include determining the unvoiced strength.

In another general aspect, a method of synthesizing a signal is provided including determining a voiced signal, determining a voiced strength, determining a pulsed signal, determining a pulsed strength, dividing the voiced signal and the pulsed signal into two or more frequency bands, and combining the voiced signal and the pulsed signal based on the voiced strength and the pulsed strength. The pulsed signal may be determined by combining a transform magnitude with a transform phase computed from the transform magnitude.

In another general aspect, a method of synthesizing a signal is provided. The method includes determining a voiced signal; determining a voiced strength; determining a pulsed signal; determining a pulsed strength; determining an unvoiced signal; determining an unvoiced strength; dividing the voiced signal, pulsed signal, and unvoiced signal into two or more frequency bands; and combining the voiced signal, the pulsed signal, and the unvoiced signal based on the voiced strength, the pulsed strength, and the unvoiced strength.

In another general aspect, a method of quantizing speech model parameters is provided. The method includes determining the voiced error between a voiced strength parameter and quantized voiced strength parameters, determining the pulsed error between a pulsed strength parameter and quantized pulsed strength parameters, combining the voiced error and the pulsed error to produce a total error, and selecting the quantized voice strength and the quantized pulsed strength which produce the smallest total error.

In another general aspect, a method of quantizing speech model parameters is provided. The method includes determining a quantized voiced strength, determining a quantized pulsed strength. The method further includes either quantizing a fundamental frequency based on the quantized voice strength and the quantized pulsed strength or quantizing a pulse position based on the quantized voiced strength and the quantized pulsed strength. The fundamental frequency may be quantized to a constant when the quantized voiced strength is zero for all frequency bands and the pulse position may be quantized to a constant when the quantized voiced strength is nonzero in any frequency band.

The details of one or more implementations are set forth in the accompanying drawings and the description below. Other features and advantages will be apparent from the description and drawings, and from the claims.

BRIEF DESCRIPTION OF THE DRAWINGS

FIG. 1 is a block diagram of a speech synthesis system using an improved speech model.

FIG. 2 is a block diagram of an analysis system for estimating parameters of the improved speech model.

FIG. 3 is a block diagram of a pulsed analysis unit that may be used with the analysis system of FIG. 2.

FIG. 4 is a block diagram of a pulsed analysis with reduced complexity.

FIG. 5 is a block diagram of an excitation parameter quantization system.

DETAILED DESCRIPTION

FIGS. 1–5 show the structure of a system for speech coding, the various blocks and units of which may be implemented with software.

FIG. 1 shows a speech synthesis system 10 that uses an improved speech model which augments the typical excitation parameters with additional parameters for higher quality speech synthesis. Speech synthesis system 10 includes a voiced synthesis unit 11, an unvoiced synthesis unit 12, and a pulsed synthesis unit 13. The audio signals produced by these units are added together by a summation unit 14.

In addition to parameters which control the proportion of quasi-periodic and noise-like signals in each frequency band, a parameter is added which controls the proportion of pulse-like signals in each frequency band. These parameters are functions of time (t) and frequency (w) and are denoted by V(t,w) for the quasi-periodic voiced strength (distribution of voiced speech power over frequency and time), U(t,w) for the noise-like unvoiced strength (distribution of unvoiced speech power over frequency and time), and P(t,w) for the pulsed signal strength (distribution of the power of the pulse component of the speech signal over frequency and time). Typically, the voiced strength parameter V(t,w) varies between zero indicating no voiced signal at time t and frequency w and one indicating the signal at time t and frequency w is entirely voiced. The unvoiced strength and pulse strength parameters behave in a similar manner. Typically, the voiced strength parameters are constrained so that they sum to one (i.e., V(t,w)+U(t,w)+P(t,w)=1).

The voiced strength parameter V(t,w) has an associated vector of parameters v(t,w) which contains voiced excitation parameters and voiced system parameters. The voiced excitation parameters can include a time and frequency dependent fundamental frequency $w_0(t,w)$ (or equivalently a pitch period $n_0(t,w)$). In this implementation, the unvoiced strength parameter U(t,w) has an associated vector of parameters u(t,w) which contains unvoiced excitation parameters and unvoiced system parameters. The unvoiced excitation parameters may include, for example, statistics and energy distribution. Similarly, the pulsed excitation strength parameter P(t,w) has an associated vector of parameters p(t,w) containing pulsed excitation parameters and pulsed system parameters. The pulsed excitation parameters may include one or more pulse positions $t_0(t,w)$ and amplitudes.

The voiced parameters V(t,w) and v(t,w) control voiced synthesis unit 11. Voiced synthesis unit 11 synthesizes the quasi-periodic voiced signal using one of several known methods for synthesizing voiced signals. One method for synthesizing voiced signals is disclosed in U.S. Pat. No. 5,195,166, titled "Methods for Generating the Voiced Portion of Speech Signals," which is incorporated by reference. Another method is that used by the MBE vocoder which sums the outputs of sinusoidal oscillators with amplitudes, frequencies, and phases that are interpolated from one frame to the next to prevent discontinuities. The frequencies of these oscillators are set to the harmonics of the fundamental (except for small deviations due to interpolation). In one implementation, the system parameters are samples of the spectral envelope estimated as disclosed in U.S. Pat. No. 5,754,974, titled "Spectral Magnitude Representation for Multi-Band Excitation Speech Coders," which is incorporated by reference. The amplitudes of the harmonics are weighted by the voiced strength V(t,w) as in the MBE vocoder. The system phase may be estimated from the samples of the spectral envelope as disclosed in U.S. Pat. No. 5,701,390, titled "Synthesis of MBE-Based Coded Speech using Regenerated Phase Information," which is incorporated by reference.

The unvoiced parameters U(t,w) and u(t,w) control unvoiced synthesis unit 12. Unvoiced synthesis unit 12 synthesizes the noise-like unvoiced signal using one of several known methods for synthesizing unvoiced signals. One method is that used by the MBE vocoder which generates samples of white noise. These white noise samples are then transformed into the frequency domain by applying a window and fast Fourier transform (FFT). The white noise transform is then multiplied by a noise envelope signal to produce a modified noise transform. The noise envelope signal adjusts the energy around each spectral envelope sample to the desired value. The unvoiced signal is then synthesized by taking the inverse FFT of the modified noise transform, applying a synthesis window, and overlap adding the resulting signals from adjacent frames.

The pulsed parameters P(t,w) and p(t,w) control pulsed synthesis unit 13. Pulsed synthesis unit 13 synthesizes the pulsed signal by synthesizing one or more pulses with the positions and amplitudes contained in p(t,w) to produce a pulsed excitation signal. The pulsed excitation is then passed through a filter generated from the system parameters. The magnitude of the filter as a function of frequency w is weighted by the pulsed strength P(t,w). Alternatively, the magnitude of the pulses as a function of frequency can be weighted by the pulsed strength.

The voiced signal, unvoiced signal, and pulsed signal produced by units 11, 12, and 13 are added together by summation unit 14 to produce the synthesized speech signal.

FIG. 2 shows a speech analysis system 20 that estimates improved model parameters from an input signal. The speech analysis system 20 includes a sampling unit 21, a voiced analysis unit 22, an unvoiced analysis unit 23, and a pulsed analysis unit 24. The sampling unit 21 samples an analog input signal to produce a speech signal $s_0(n)$. It should be noted that sampling unit 21 operates remotely from the analysis units in many applications. For typical speech coding or recognition applications, the sampling rate ranges between 6 kHz and 16 kHz.

The voiced analysis unit 22 estimates the voiced strength V(t,w) and the voiced parameters v(t,w) from the speech signal $s_0(n)$. The unvoiced analysis unit 23 estimates the unvoiced strength U(t,w) and the unvoiced parameters u(t,w) from the speech signal $s_0(n)$. The pulsed analysis unit 24 estimates the pulsed strength P(t,w) and the pulsed signal parameters p(t,w) from the speech signal $s_0(n)$. The vertical arrows between analysis units 22–24 indicate that information flows between these units to improve parameter estimation performance.

The voiced analysis and unvoiced analysis units can use known methods such as those used for the estimation of MBE model parameters as disclosed in U.S. Pat. No. 5,715, 365, titled "Estimation of Excitation Parameters" and U.S. Pat. No. 5,826,222, titled "Estimation of Excitation Parameters," both of which are incorporated by reference. The described implementation of the pulsed analysis unit uses new methods for estimation of the pulsed parameters.

Referring to FIG. 3, the pulsed analysis unit 24 includes a window and Fourier transform unit 31, an estimate pulse FT and synthesize pulsed FT unit 32, and a compare unit 33. The pulsed analysis unit 24 estimates the pulsed strength P(t,w) and the pulsed parameters p(t,w) from the speech signal $s_0(n)$.

The window and Fourier transform unit 31 multiplies the input speech signal $s_0(n)$ by a window w(t,n) centered at time t to obtain a windowed signal s(t,n). The window used is typically a Hamming window or Kaiser window and is typically constant as a function of t so that $w(t,n)=w_0(n-t)$. The length of the window w(t,n) typically ranges between 5 ms and 40 ms. The Fourier transform (FT) of the windowed signal S(t,w) is typically computed using a fast Fourier transform (FFT) with a length greater than or equal to the number of samples in the window. When the length of the FFT is greater than the number of windowed samples, the additional samples in the FFT are zeroed.

The estimate pulse FT and synthesize pulsed FT unit 32 estimates a pulse from S(t,w) and then synthesizes a pulsed signal transform $\hat{S}(t,w)$ from the pulse estimate and a set of pulse positions and amplitudes. The synthesized pulsed transform $\hat{S}(t,w)$ is then compared to the speech transform S(t,w) using compare unit 33. The comparison is performed using an error criterion. The error criterion can be optimized over the pulse positions, amplitudes, and pulse shape. The optimum pulse positions, amplitudes, and pulse shape become the pulsed signal parameters $\underline{p}(t,w)$. The error between the speech transform S(t,w) and the optimum pulsed transform $\hat{S}(t,w)$ is used to compute the pulsed signal strength P(t,w).

A number of techniques exist for estimating the pulse Fourier transform. For example, the pulse can be modeled as the impulse response of an all-pole filter. The coefficients of the all-pole filter can be estimated using well known algorithms such as the autocorrelation method or the covariance method. Once the pulse is estimated, the pulsed Fourier transform can be estimated by adding copies of the pulse with the positions and amplitudes specified. The pulsed Fourier transform is then compared to the speech transform using an error criterion such as weighted squared error. The error criterion is evaluated at all possible pulse positions and amplitudes or some constrained set of positions and amplitudes to determine the best pulse positions, amplitudes, and pulse FT.

Another technique for estimating the pulse Fourier transform is to estimate a minimum phase component from the magnitude of the short time Fourier transform (STFT) |S(t,w)| of the speech. This minimum phase component may be combined with the speech transform magnitude to produce a pulse transform estimate. Other techniques for estimating the pulse Fourier transform include pole-zero models of the pulse and corrections to the minimum phase approach based on models of the glottal pulse shape.

Some implementations emply an error criterion having reduced sensitivity to time shifts (linear phase shifts in the Fourier transform). This type of error criterion can lead to reduced computational requirements since the number of time shifts at which the error criterion needs to be evaluated can be significantly reduced. In addition, reduced sensitivity to linear phase shifts improves robustness to phase distortions which are slowly changing in frequency. These phase distortions are due to the transmission medium or deviations of the actual system from the model. For example, the following equation may be used as an error criterion:

$$E(t) = \min_{\theta} \int_{-\pi}^{\pi} G(t,\omega)\left|S(t,\omega)S^*(t,\omega-\Delta\omega) - e^{j\theta}\hat{S}(t,\omega)\hat{S}^*(t,\omega-\Delta\omega)\right|^2 d\omega \tag{1}$$

In Equation (1), S(t,w) is the speech STFT, $\hat{S}(t,w)$ is the pulsed transform, G(t,w) is a time and frequency dependent weighting, and θ is a variable used to compensate for linear phase offsets. To see how θ compensates for linear phase offsets, it is useful to consider an example. Suppose the speech transform is exactly matched with the pulsed transform except for a linear phase offset so that $\hat{S}(t,w)=e^{-jwt_0}S(t,w)$. Substituting this relation into Equation (1) yields $$E(t) = \min_{\theta} \int_{-\pi}^{\pi} G(t,\omega)\left|S(t,\omega)S^*(t,\omega-\Delta\omega)\right.\left[1-e^{j(\theta-\Delta\omega t_0)}\right]^2 d\omega \tag{2}$$

which is minimized over θ at $\theta_{min}=\Delta w t_0$. In addition, once $\theta_{min}$ is known, the time shift $t_0$ can be estimated by $$t_0 = \frac{\theta_{\min}}{\Delta\omega} \tag{3}$$

where Δw is typically chosen to be the frequency interval between adjacent FFT samples.

Equation (1) is minimized by choosing θ as follows $$\theta_{\min}(t) = \arctan\left[\int_{-\pi}^{\pi} G(t,\omega)S(t,\omega)S^*(t,\omega-\Delta\omega)\hat{S}^*(t,\omega)S(t,\omega-\Delta\omega)d\omega\right]. \tag{4}$$

When computing $\theta_{min}(t)$ using Equation (4), if G(t,w)=1, the frequency weighting is approximately $|S(t,w)|^4$. This tends to weight frequency regions with higher energy too heavily relative to frequency regions of lower energy. G(t,w) may be used to adjust the frequency weighting. The following function for G(t,w) may be used to improve performance in typical applications:

$$G(t,\omega) = \frac{F(t,\omega)}{\sqrt{\left|S(t,\omega)S^*(t,\omega-\Delta\omega)\hat{S}^*(t,\omega)\hat{S}(t,\omega-\Delta\omega)\right|}} \tag{5}$$

where F(t,w) is a time and frequency weighting function. There are a number of choices for F(t,w) which are useful in practice. These include F(t,w)=1, which is simple to implement and achieves good results for many applications. A better choice for many applications is to make F(t,w) larger in frequency regions with higher pulse-to-noise ratios and smaller in regions with lower pulse-to-noise ratios. In this case, "noise" refers to non-pulse signals such as quasi-periodic or noise-like signals. In one implementation, the weighting F(t,w) is reduced in frequency regions where the estimated voiced strength V(t,w) is high. In particular, if the voiced strength V(t,w) is high enough that the synthesized signal would consist entirely of a voiced signal at time t and frequency w then F(t,w) would have a value of zero. In addition, F(t,w) is zeroed out for w<400 Hz to avoid deviations from minimum phase typically present at low frequencies. Perceptually based error criteria can also be factored into F(t,w) to improve performance in applications where the synthesized signal is eventually presented to the ear.

After computing $\theta_{min}(t)$, a frequency dependent error E(t,w) may be defined as:

$$E(t,w)=G(t,w)|S(t,w)S_w(t,w-\Delta w)-e^{j\theta_{min}}\hat{S}(t,w)\hat{S}^*(t,w-\Delta w)|^2. \quad (6)$$

The error E(t,w) is useful for computation of the pulsed signal strength P(t,w). When computing the error E(t,w), the weighting function F(t,w) is typically set to a constant of one. A small value of E(t,w) indicates similarity between the speech transform S(t,w) and the pulsed transform $\hat{S}(t,w)$, which indicates a relatively high value of the pulsed signal strength P(t,w). A large value of E(t,w) indicates dissimilarity between the speech transform S(t,w) and the pulsed transform $\hat{S}(t,w)$, which indicates a relatively low value of the pulsed signal strength P(t,w).

FIG. 4 shows a pulsed Analysis unit 24 that includes a window and FT unit 41, a synthesize phase unit 42, and a minimize error unit 43. The pulsed analysis unit 24 estimates the pulsed strength P(t,w) and the pulsed parameters from the speech signal $s_0(n)$ using a reduced complexity implementation. The window and FT unit 41 operates in the same manner as previously described for unit 31. In this implementation, the number of pulses is reduced to one per frame in order to reduce computation and the number of parameters. For applications such as speech coding, reduction of the number of parameters is helpful for reduction of speech coding rates. The synthesize phase unit 42 computes the phase of the pulse Fourier transform using well known homomorphic vocoder techniques for computing a Fourier transform with minimum phase from the magnitude of the speech STFT |S(t,w)|. The magnitude of the pulse Fourier transform is set to |S(t,w)|. The system parameter output ρ(t,w) consists of the pulse Fourier transform.

The minimize error unit 43 computes the pulse position $t_0$ using Equations (3) and (4). For this implementation, the pulse position $t_0(t,w)$ varies with frame time t but is constant as a function of w. After computing $\theta_{min}$, the frequency dependent error E(t,w) is computed using Equation (6). The normalizing function D(t,w) is computed using $$D(t,w)=G(t,w)|S(t,w)S^*(t,w-\Delta w)|^2 \quad (7)$$

and applied to the computation of the pulsed excitation strength $$P(t,\omega)=\begin{cases}0, & P'(t,\omega)<0\\ P'(t,\omega), & 0\le P'(t,\omega)\le 1 \quad \text{where}\\ 1, & P'(t,\omega)>1\end{cases} \quad (8)$$

$$P'(t,\omega)=\frac{1}{2}\log_2\left(\frac{2\tau\overline{D}(t,\omega)}{\overline{E}(t,\omega)}\right), \quad (9)$$

$\overline{E}(t,w)$ and $\overline{D}(t,w)$ are frequency smoothed versions of E(t,w) and D(t,w), and τ is a threshold typically set to a constant of 0.1. Since $\overline{E}(t,w)$ and $\overline{D}(t,w)$ are frequency smoothed (low pass filtered), they can be downsampled in frequency without loss of information. In one implementation, $\overline{E}(t,w)$ and $\overline{D}(t,w)$ are computed for eight frequency bands by summing E(t,w) and D(t,w) over all w in a particular frequency band. Typical band edges for these 8 frequency bands for an 8 kHz sampling rate are 0 Hz, 375 Hz, 875 Hz, 1375 Hz, 1875 Hz, 2375 Hz, 2875 Hz, 3375 Hz, and 4000 Hz.

It should be noted that the above frequency domain computations are typically carried out using frequency samples computed using fast Fourier transforms (FFTs). Then, the integrals are computed using summations of these frequency samples.

Referring to FIG. 5, an excitation parameter quantization system 50 includes a voiced/unvoiced/pulsed (V/U/P) strength quantizer unit 51 and a fundamental and pulse position quantizer unit 52. Excitation parameter quantization system 50 jointly quantizes the voiced strength V(t,w), the unvoiced strength U(t,w), and the pulsed strength P(t,w) to produce the quantized voiced strength $\check{V}(t,w)$, the quantized unvoiced strength $\check{U}(t,w)$, and the quantized pulsed strength $\check{P}(t,w)$ using V/U/P strength quantizer unit 51. Fundamental and pulse position quantizer unit 52 quantizes the fundamental frequency $w_0(t,w)$ and the pulse position $t_0(t,w)$ based on the quantized strength parameters to produce the quantized fundamental frequency $\check{w}_0(t,w)$ and the quantized pulse position $\check{t}_0(t,w)$.

One implementation uses a weighted vector quantizer to jointly quantize the strength parameters from two adjacent frames using 7 bits. The strength parameters are divided into 8 frequency bands. Typical band edges for these 8 frequency bands for an 8 kHz sampling rate are 0 Hz, 375 Hz, 875 Hz, 1375 Hz, 1875 Hz, 2375 Hz, 2875 Hz, 3375 Hz, and 4000 Hz. The codebook for the vector quantizer contains 128 entries consisting of 16 quantized strength parameters for the 8 frequency bands of two adjacent frames. To reduce storage in the codebook, the entries are quantized so that for a particular frequency band a value of zero is used for entirely unvoiced, one is used for entirely voiced, and two is used for entirely pulsed.

For each codebook index m the error is evaluated using $$E_m=\sum_{n=0}^{1}\sum_{k=0}^{7}\alpha(t_n,\omega_k)E_m(t_n,\omega_k) \quad (10)$$

where $$E_m(t_n,w_k)=\max[(V(t_n,w_k)-\check{V}_m(t_n,w_k))^2,\ (1-\check{V}_m(t_n,w_k))\ (P(t_n,w_k)-\check{P}_m(t_n,w_k))^2], \quad (11)$$

$\alpha(t_n, w_k)$ is a frequency and time dependent weighting typically set to the energy in the speech transform $S(t_n, w_k)$ around time $t_n$ and frequency $w_k$, max(a,b) evaluates to the maximum of a or b, and $\check{V}_m(t_n, w_k)$ and $\check{P}_m(t_n, w_k)$ are the quantized voicing strength and quantized pulse strength. The error $E_m$ of Equation (10) is computed for each codebook index m and the codebook index is selected which minimizes $E_m$.

In another preferred embodiment, the error $E_m(t_n, w_k)$ of Equation (11) is replaced by $$E_m(t_n,w_k)=\gamma_m(t_n,w_k)+\beta(1-\check{V}_m(t_n,w_k))\ (1-\gamma_m(t_n,w_k))\ (P(t_n,w_k)-\check{P}_m(t_n,w_k))^2, \quad (12)$$

where $$\gamma_m(t_n,w_k)=(V(t_n,w_k)-\check{V}_m(t_n,w_k))^2 \quad (13)$$

and β is typically set to a constant of 0.5.

If the quantized voiced strength $\check{V}(t,w)$ is non-zero at any frequency for the two current frames, then the two fundamental frequencies for these frames are jointly quantized using 9 bits, and the pulse positions are quantized to zero (center of window) using no bits.

If the quantized voiced strength $\check{V}(t,w)$ is zero at all frequencies for the two current frames and the quantized pulsed strength $\check{P}(t,w)$ is non-zero at any frequency for the current two frames, then the two pulse positions for these frames may be quantized using, for example 9 bits, and the fundamental frequencies are set to a value of, for example, 64.84 Hz using no bits.

If the quantized voiced strength $\check{V}(t,w)$ and the quantized pulsed strength $\check{P}(t,w)$ are both zero at all frequencies for the current two frames, then the two pulse positions for these frames are quantized to zero, and the fundamental frequencies for these frames may be jointly quantized using 9 bits.

Other implementations are within the following claims.

What is claimed is:

1. A method of analyzing a digitized speech signal to determine model parameters for the digitized signal, the method comprising:

receiving a digitized speech signal;

determining a voiced strength for the digitized signal by evaluating a first function; and determining a pulsed strength for the digitized signal by evaluating a second function.

2. The method of claim 1 wherein determining the voiced strength and determining the pulsed strength are performed at regular intervals of time.

3. The method of claim 1 wherein determining the voiced strength and determining the pulsed strength are performed on one or more frequency bands.

4. The method of claim 1 wherein determining the voiced strength and determining the pulsed strength are performed on two or more frequency bands and the first function is the same as the second function.

5. The method of claim 1 wherein the voiced strength and the pulsed strength are used to encode the digitized signal.

6. The method of claim 1 wherein the voiced strength is used in determining the pulsed strength.

7. The method of claim 1 wherein the pulsed strength is determined using a pulsed signal estimated from the digitized signal.

8. The method of claim 7 wherein the pulsed signal is determined by combining a frequency domain transform magnitude with a transform phase computed from a transform magnitude.

9. The method of claim 8 wherein the transform phase is near minimum phase.

10. The method of claim 7 wherein the pulsed strength is determined using a pulsed signal estimated from a pulsed signal and at least one pulse position.

11. The method of claim 1 wherein the pulsed strength is determined by comparing a pulsed signal with the digitized signal.

12. The method of claim 11 wherein the pulsed strength is determined by performing a comparison using an error criterion with reduced sensitivity to time shifts.

13. The method of claim 12 wherein the error criterion computes phase differences between frequency samples.

14. The method of claim 13 wherein the effect of constant phase differences is removed.

15. The method of claim 1 further comprising:

quantizing the pulsed strength using a weighted vector quantization; and quantizing the voiced strength using weighted vector quantization.

16. The method of claim 1 wherein the voiced strength and the pulsed strength are used to estimate one or more model parameters.

17. The method of claim 1 further comprising determining the unvoiced strength.

18. A method of synthesizing a speech signal, the method comprising:

determining a voiced signal;

determining a voiced strength;

determining a pulsed signal;

determining a pulsed strength;

dividing the voiced signal and the pulsed signal into two or more frequency bands; and combining the voiced signal and the pulsed signal based on the voiced strength and the pulsed strength.

19. The method of claim 18 wherein the pulsed signal is determined by combining a frequency domain transform magnitude with a transform phase computed from the transform magnitude.

20. A method of synthesizing a speech signal, the method comprising:

determining a voiced signal;

determining a voiced strength;

determining a pulsed signal;

determining a pulsed strength;

determining an unvoiced signal;

determining an unvoiced strength;

dividing the voiced signal, pulsed signal, and unvoiced signal into two or more frequency bands; and combining the voiced signal, the pulsed signal, and the unvoiced signal based on the voiced strength, the pulsed strength, and the unvoiced strength.

21. A method of quantizing speech model parameters, the method comprising:

determining the voiced error between a voiced strength parameter and quantized voiced strength parameters;

determining the pulsed error between a pulsed strength parameter and quantized pulsed strength parameters;

combining the voiced error and the pulsed error to produce a total error; and selecting the quantized voiced strength and the quantized pulsed strength which produce the smallest total error.

22. A method of quantizing speech model parameters, the method comprising:

determining a quantized voiced strength;

determining a quantized pulsed strength; and quantizing a fundamental frequency based on the quantized voiced strength and the quantized pulsed strength.

23. The method of claim 22 wherein the fundamental frequency is quantized to a constant when the quantized voiced strength is zero for all frequency bands.

24. A method of quantizing speech model parameters, the method comprising:

determining a quantized voiced strength;

determining a quantized pulsed strength; and quantizing a pulse position based on the quantized voiced strength and the quantized pulsed strength.

25. The method of claim 24 wherein the pulse position is quantized to a constant when the quantized voiced strength is nonzero in any frequency band.

26. A computer software system for analyzing a digitized speech signal to determine model parameters for the digitized signal comprising:

a voiced analysis unit operable to determine a voiced strength for the digitized speech signal by evaluating a first function; and a pulsed analysis unit operable to determine a pulsed strength for the digitized signal by evaluating a second function.

27. The system of claim 26 wherein the voiced strength and the pulsed strength are determined at regular intervals of time.

28. The system of claim 26 wherein the voiced strength and the pulsed strength are determined on one or more frequency bands.

29. The system of claim 26 wherein the voiced strength and the pulsed strength are determined on two or more frequency bands and the first function is the same as the second function.

30. The system of claim 26 wherein the voiced strength and the pulsed strength are used to encode the digitized signal.

31. The system of claim 26 wherein the voiced strength is used to determine the pulsed strength.

32. The system of claim 26 wherein the pulsed strength is determined using a pulse signal estimated from the digitized signal.

33. The system of claim 32 wherein the pulsed signal is determined by combining a frequency domain transform magnitude with a transform phase computed from a transform magnitude.

34. The system of claim 33 wherein the transform phase is near minimum phase.

35. The system of claim 32 wherein the pulsed strength is determined using a pulsed signal estimated from a pulse signal and at least one pulse position.

36. The system of claim 26 wherein the pulsed strength is determined by comparing a pulsed signal with the digitized signal.

37. The system of claim 36 wherein the pulsed strength is determined by performing a comparison using an error criterion with reduced sensitivity to time shifts.

38. The system of claim 37 wherein the error criterion computes phase differences between frequency samples.

39. The system of claim 38 wherein the effect of constant phase differences is removed.

40. The system of claim 26 further comprising an unvoiced analysis unit.

41. A method of analyzing a digitized speech signal to determine model parameters for the digitized signal, the method comprising:

receiving a digitized speech signal; and evaluating an error criterion with reduced sensitivity to time shifts to determine pulse parameters for the digitized signal.

42. The method of claim 41 further comprising determining a pulsed strength.

43. The method of claim 42 wherein the pulsed strength is determined in two or more frequency bands.

44. The method of claim 41 wherein the error criterion computes phase differences between frequency samples.

45. The method of claim 44 wherein the effect of constant phase differences is removed.

* * * * *